US009416917B2

(12) United States Patent
London

(10) Patent No.: US 9,416,917 B2
(45) Date of Patent: Aug. 16, 2016

(54) SMALL-SCALE METAL TANKS FOR HIGH PRESSURE STORAGE OF FLUIDS

(71) Applicant: Ventions, LLC, San Francisco, CA (US)

(72) Inventor: Adam London, San Francisco, CA (US)

( * ) Notice: Subject to any disclaimer, the term of this patent is extended or adjusted under 35 U.S.C. 154(b) by 774 days.

(21) Appl. No.: 13/573,680

(22) Filed: Oct. 3, 2012

(65) Prior Publication Data

US 2013/0098918 A1 Apr. 25, 2013

Related U.S. Application Data

(60) Provisional application No. 61/542,629, filed on Oct. 3, 2011.

(51) Int. Cl.
*F17C 1/00* (2006.01)

(52) U.S. Cl.
CPC ..... *F17C 1/00* (2013.01)

(58) Field of Classification Search
CPC ..... F17C 1/04; F17C 1/00
USPC ..... 220/562, 564, 592, 581, 582–590
See application file for complete search history.

(56) References Cited

U.S. PATENT DOCUMENTS 5,323,953 A * 6/1994 Adderley ..... B21D 51/24 220/501
7,159,738 B2 1/2007 Luongo
7,694,840 B2 * 4/2010 Goggin ..... 220/586
8,227,144 B2 7/2012 Zimmermann
8,235,243 B2 8/2012 Illesi
9,061,788 B2 * 6/2015 Veksler et al.

OTHER PUBLICATIONS 1800 psi cylinder designs—Luxfer_Setting the Standard Worldwide; http://www.luxfercylinders.com; Oct. 3, 2012.
3000 psi cylinder designs—Luxfer_Setting the Standard Worldwide; http://www.luxfercylinders.com; Oct. 3, 2012.
Leland Limited_Small High Pressure Cylinders; http://www.lelandltd.com/small_high_pressure.htm; Oct. 3, 2012.

* cited by examiner

*Primary Examiner* — Anthony Stashick
*Assistant Examiner* — Raven Collins
(74) *Attorney, Agent, or Firm* — Keith L. Jenkins, Registered Patent Attorney, LLC; Keith L. Jenkins

(57) ABSTRACT

Small scale metal tanks for high-pressure storage of fluids having tank factors of more than 5000 meters and volumes of ten cubic inches or less featuring arrays of interconnected internal chambers having at least inner walls thinner than gage limitations allow. The chambers may be arranged as multiple internal independent vessels. Walls of chambers that are also portions of external tank walls may be arcuate on the internal and/or external surfaces, including domed. The tanks may be shaped adaptively and/or conformally to an application, including, for example, having one or more flat outer walls and/or having an annular shape. The tanks may have dual-purpose inlet/outlet conduits of may have separate inlet and outlet conduits. The tanks are made by fusion bonding etched metal foil layers patterned from slices of a CAD model of the tank. The fusion bonded foil stack may be further machined.

20 Claims, 12 Drawing Sheets

PRIOR ART FIG. 3

SMALL-SCALE METAL TANKS FOR HIGH PRESSURE STORAGE OF FLUIDS

RELATED APPLICATIONS

This application claims the benefit of U.S. Provisional Patent Application Ser. No. 61/542,629 filed Oct. 3, 2011 to the same inventor.

GOVERNMENT RIGHTS

This invention was made with government support under contract NNA08BB37C awarded by NASA and under contract HR0011-08-C-0101 awarded by DARPA. The government has certain rights in the invention.

TECHNICAL FIELD

The present invention generally relates to small storage tanks for fluids, and more particularly relates to small-scale tanks with high tank factors.

BACKGROUND

Storage of high pressure gases and liquids is a critical requirement for many applications, e.g. rocket and aircraft propulsion components, automotive airbags, pneumatic and hydraulic systems, etc. The science for design and manufacture of suitable tanks for this purpose is well documented, with many examples of commercially available tanks. Typical tanks are made in the form of spheres or cylinders, and may be manufactured from metals or composite (with or without a liner).

Pictures of representative commercially available tanks for high pressure storage of gases and liquids are shown in FIG. 1 and FIG. 2 as examples of commercially available tanks. While such tanks are relatively common in large sizes with diameters in excess of six inches, they less common in the extremely small size-class (i.e. diameters of the order of a few inches). The problem is especially difficult in extremely weight sensitive applications (i.e. rocket engines), and in applications where the pressure of the stored fluid is very high (several hundred pounds per square inch).

The realization of small high-pressure tanks has proved challenging for several reasons including that, given a limitation of minimum gage thickness for conventional materials, the mass of the walls ends up being much higher than what is required, thereby making the tanks much heavier than they need to be and it is difficult to form conventional materials into suitable cylindrical or spherical shapes at the small scale. An exemplary conventional metal tank is welded together from pieces bent sheet metal. For example, a first sheet is rolled into a cylinder, and two hemispherical ends are then formed in a press. The hemispherical ends are then welded onto the ends of the cylinder. The smallest gage aluminum which can be worked in such a process is 30 mil, and even that is very difficult and expensive. This is the practical gage limitation that prevents conventional methods from making thinner-walled aluminum tanks. Consequently, there are currently no commercially available high tank factor storage tanks in the 1-10 cubic inch size class.

A key figure-of-merit commonly used in this context is the "tank factor" which is defined as: "Failure Pressure" times "Storage Volume" divided by "Tank Weight" (the lower the tank weight for a given failure pressure and volume, the better the tank, and hence, higher the tank factor). FIG. 3 depicts the tank factors for commonly available tanks as a function of storage volume, and clearly shows that while one can achieve high tank factors (nearing 30,000 meters for storage volumes in the 100-10,000 cubic inches range), the achievable tank factor decreases with size, there being no tanks with similar performance in the small size-scale (i.e. storage volumes of 1-10 cubic inches).

The tanks that do exist in the small size scale (less than 10 cubic inches) are either single-use disposable cylinders, for example, those used to inflate life-jackets, or "sample cylinders" used for capturing and transporting small samples of gas for analysis. These are limited to cylindrical shapes and have tank factors of less than 2500 meters.

Accordingly, it is desirable to manufacture a tank with a high tank factor (approximately 8,000 meters) in the 1-10 cubic inches volume range. In addition, it is desirable to devise a method of manufacturing such tanks that is effective and economical. Furthermore, other desirable features and characteristics of the present invention will become apparent from the subsequent detailed description and the appended claims, taken in conjunction with the accompanying drawings and the foregoing technical field and background.

BRIEF SUMMARY

An apparatus is provided for storing fluids at high pressures in small volumes. The apparatus comprises one or more pressure vessels that are made up of multiple arrays of internal chambers with a single gas inlet and outlet for each vessel as well as gas feeder and connector lines.

A method is described for manufacturing small-volume tanks with high tank factors by aligning and stacking a plurality of patterned layers into a 3D shape, sandwiching the stacked layer between end wall structures, and diffusion bonding the multiple layers into a single monolithic tank with automatic fluid interconnects between internal chambers. The present invention uses a micro layer metal foil etching and diffusion bonding methodology to realize high-pressure tanks in the small size-class.

An exemplary embodiment of the invention is shown in FIG. 4 in cross section form. Herein, the 2"×2" square piece consists of two separate pressure vessels on the left and right that are made up of multiple honeycomb shaped internal chambers with a single gas inlet and outlet for each vessel as well as gas feeder and connector lines. The alignment pin referred to in FIG. 4 is used to align the different layers and ensure a good diffusion bond between the layers for structural integrity of the internal chambers in the final structure.

The creation of such smaller chambers within the pressure vessels reduces the structural requirements on the outermost metal walls, thereby allowing for a light weight structure.

A key element of the present invention is the method used to manufacture the tanks. As discussed in regard to FIGS. 20A-20D, the process involves: slicing a CAD model of the geometry into multiple layers; generating the necessary "pattern" artwork for each layer; using the pattern to etch each metal layer and create the pre-formed shapes; aligning and stacking of each of the layers into a 3D shape, and sandwiching between end wall structures; diffusion bonding the multiple layers into a single monolithic tank with automatic fluid interconnects between internal chambers; and external machining of the structure to release the final geometry and create access ports.

The invention provides A small scale metal tank for high pressure storage of fluids including: a tank factor of at least three thousand meters and a tank volume of at most ten cubic inches. The tank, including: an enclosure including a plurality of outer tank walls; an array of internal chambers within the enclosure; a plurality of fluidic interconnections between each of the internal chambers of the array of internal chambers and each other internal chamber of the array of internal chambers; and a fluidic conduit between an internal chamber of the a array of internal chambers and a point external to the enclosure. The tank, where the outer tank wall of the plurality of outer tank walls includes a flat outer tank wall. The tank, where the enclosure includes a shape that is adapted to and/or conformal to a particular mechanical application. The tank, where the array of internal chambers is formed of diffusion-bonded metal layers having diffusion-bonded seams between adjacent layers. The tank, where each chamber of the array of internal chambers has: opposed first and second end walls: a plurality of side walls extending between the opposed first and second end walls; an internal junction between a side wall of the plurality of side walls and one of the opposed first and second end walls; and a filet at the internal junction, where the filet includes no fusion-bonding seams. The tank, where either the opposed first and second end walls include a portion of an outer tank wall of the plurality of outer tank walls and the portion of the outer tank wall includes an arcuate shape that is internal and/or external. The tank, where a side wall of the plurality of side walls includes a portion of an outer tank wall of the plurality of outer tank walls and the portion of the outer tank wall includes an arcuate shape that is internal and/or external. The tank, where the at least one array of chambers includes two or more arrays of chambers, each forming an independent vessel within the enclosure and each having fluidically interconnected chambers within each of the two or more arrays of chambers and each vessel having a fluidic conduit external to the enclosure.

A small scale metal tank for high pressure storage of fluids having: a tank factor of at least three thousand meters; and a tank volume of at most ten cubic inches; where the tank includes: an enclosure including a plurality of outer tank walls; at least one array of internal chambers within the enclosure; an internal junction between a side wall of the plurality of side walls and one of the opposed first and second end walls; and a filet at the internal junction, where the filet includes no the fusion-bonding seams. The tank, where the outer tank wall of the plurality of outer tank walls includes a flat outer tank wall. The tank, where the enclosure includes: a shape adapted to fit adaptively and/or conformally with a particular mechanical device; and a shape that is not spherical. The tank, where the array of internal chambers is formed of diffusion-bonded metal layers having diffusion-bonded seams between adjacent diffusion-bonded layers. The tank, where each chamber of the array of internal chambers has: opposed first and second end walls: a plurality of side walls extending between the first and second end walls; an internal junction between a side wall of the plurality of side walls and one of the first and second end walls; and a filet at the internal junction, where the filet includes no the diffusion-bonding seams. The tank, where one of the first and second end walls includes a portion of an outer tank wall of the plurality of outer tank walls and the portion of the outer tank wall includes an arcuate shape that is internal and/or external. The tank, where one side wall of the plurality of side walls includes a portion of an outer tank wall of the plurality of outer tank walls and the portion of the outer tank wall includes an arcuate shape that is internal and/or external. The tank, where the at least one array of chambers includes two or more arrays of chambers, each forming an independent vessel within the enclosure and each having fluidically interconnected chambers within each of the two or more arrays of chambers and each vessel having a fluidic conduit terminating external to the enclosure.

A small scale metal tank for high pressure storage of fluids having: a tank factor of at least three thousand meters and a tank volume of at most ten cubic inches; where the tank includes: an enclosure including a plurality of outer tank walls; at least one array of internal chambers within the enclosure; an internal junction between a side wall of the plurality of side walls and one of the opposed first and second end walls; and a filet at the internal junction, where the filet includes no the fusion-bonding seams; where the enclosure includes: a shape adapted to fit adaptively and/or conformally with a particular mechanical device; a shape that is not spherical; and a shape that does not have a hemispherical tank end; where each chamber of the array of internal chambers includes: a plurality of diffusion-bonded metal layers having diffusion-bonded seams between adjacent the diffusion-bonded layers; opposed first and second end walls each including one diffusion-bonded layer of the plurality of the diffusion-bonded layers; a plurality of side walls each comprised of a stack of the fusion bonded layers and extending between the opposed first and second end walls; an internal junction between a side wall of the plurality of side walls and one of the opposed first and second end walls; and a filet at each the internal junction, where the filet includes no diffusion-bonding seams. The tank, where either the first end wall, the second end wall, and a side wall of the plurality of side walls of the chamber includes a portion of an outer tank wall of the plurality of outer tank walls and the portion of the outer tank wall includes an arcuate surface that is internal and/or external. The tank, further including the tank attached to the particular mechanical device.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
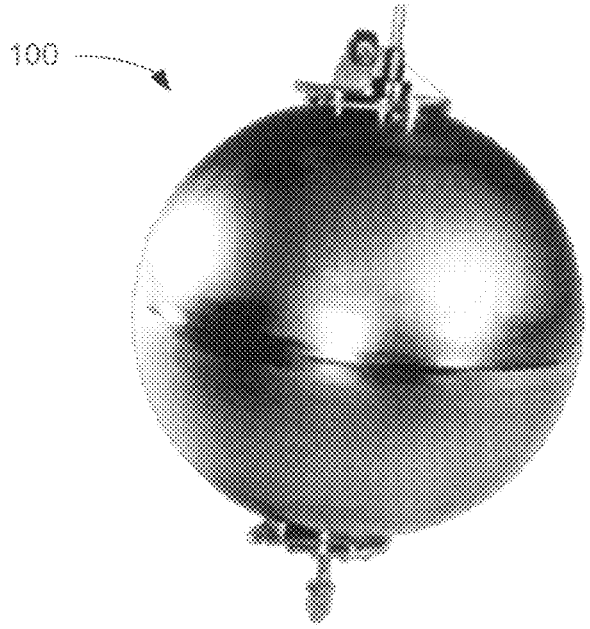
PRIOR ART FIG. 1
FIG. 1 is a front perspective view illustrating a prior art tank in the 100-10,000 cubic inches volume range.

FIG. 1 is a perspective view illustrating a prior art tank 100 in the 100-10,000 cubic inches volume range. Tank 100 is a spherical tank.

Figure 2:
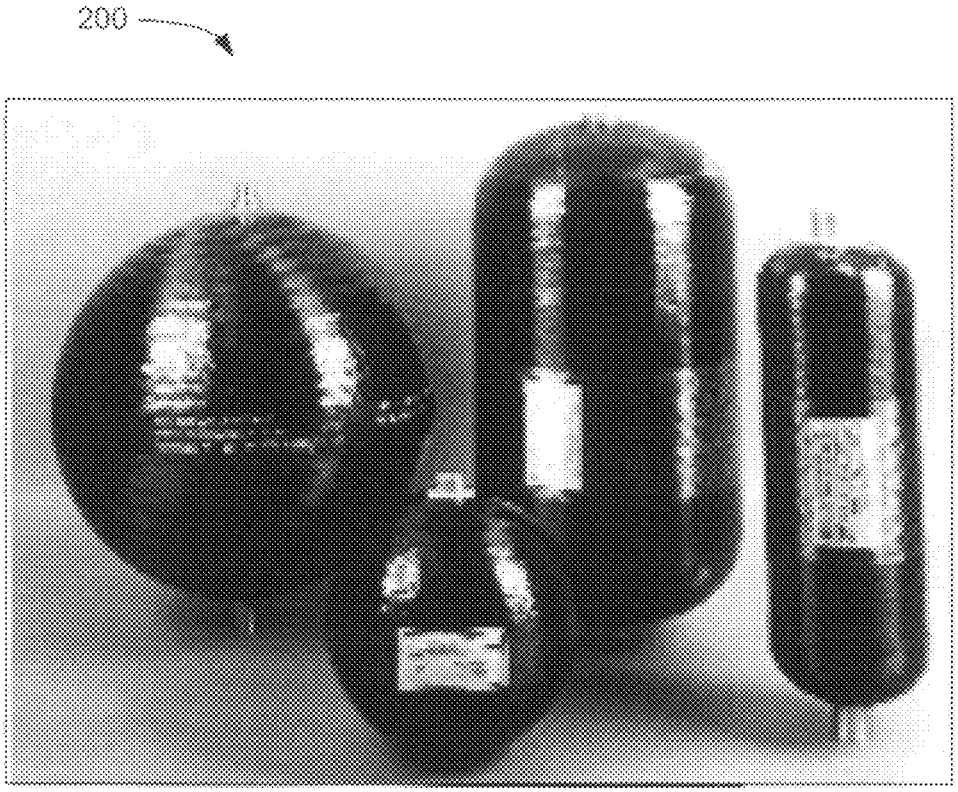
FIG. 2 PRIOR ART
FIG. 2 is a front perspective view illustrating a plurality of prior art tanks in the 100-10,000 cubic inches volume range.

FIG. 2 is a perspective view illustrating a plurality of prior art tanks 200 in the 100-10,000 cubic inches volume range. Two spherical tanks and two cylindrical tanks with hemispherical tank ends are shown.

Figure 3:
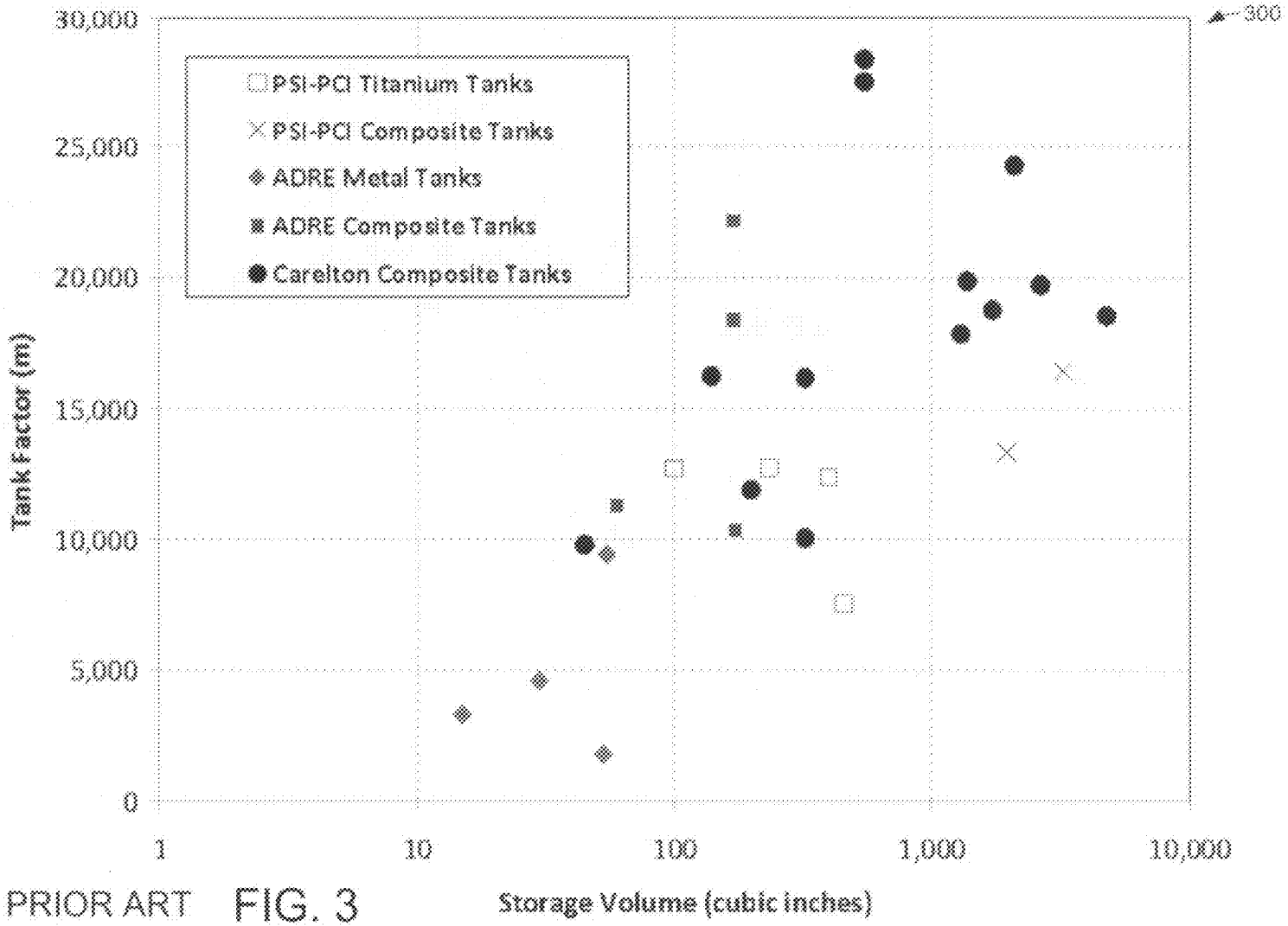
FIG. 3 is a chart illustrating tank factor vs. storage volume for prior art tanks.

FIG. 3 is a chart 300 illustrating tank factor vs. storage volume for prior art tanks. The prior art has no tank factors above 3,000 meters for tanks in the 1-10 cubic-inch volume range. The upper volume limit is actually slightly greater than ten cubic inches, as shown. More precisely, the chart 300 shows no tank factors above zero meters in tanks under ten cubic inch volume. Tanks that do exist in the small size scale (less than 10 cubic inches) are either single-use disposable cylinders, for example, those used to inflate life-jackets, or "sample cylinders" used for capturing and transporting small samples of gas for analysis. These are limited to cylindrical shapes and have tank factors of less than 2500 meters.

Figure 4:
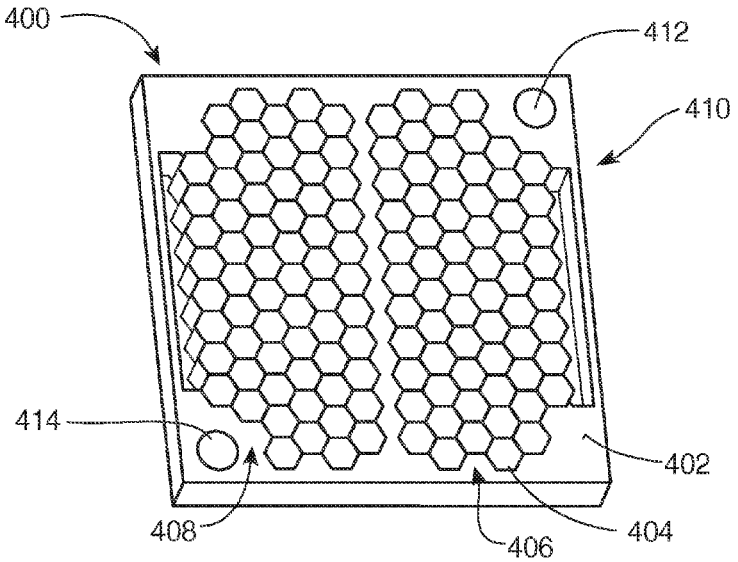
FIG. 4 is a perspective view illustrating an exemplary embodiment of the foil-layer stack and internal tank structure for a small volume, high tank factor, tank, according to an embodiment of the present invention.

FIG. 4 is a perspective view illustrating an exemplary embodiment of the foil-layer stack structure 400 showing the internal tank structure 410 for a small volume, high tank factor, tank, according to an embodiment of the present invention. The internal tank structure 410 includes first vessel 406 and second vessel 408 made of an interconnected (see FIG. 9) array of chambers 404 (one of 128 labeled) in a frame 402. The chambers 404 are illustrated as hexagonal in cross-section, but the invention is not so limited. In various embodiments, various cross-sectional shapes may be used, as will be discussed and illustrated in greater detail below. The internal tank structure 410 is made by bonding foil layers together in a vertical stack 400. The fingers in the illustration are not part of the invention, but give an approximate size reference.

An embodiment of the invention is shown in FIG. 4 in cross section form. Herein, the 2"×2" square piece consists of two separate pressure vessels 408 and 406 on the left and right, respectively, that are made up of a honeycomb of hexagonal-shaped internal chambers 404 with a single gas inlet 914 and 916 (see FIG. 9) for each vessel 406 and 408 as well as gas feeder and connector lines 904 and 906, respectively.

Figure 5:
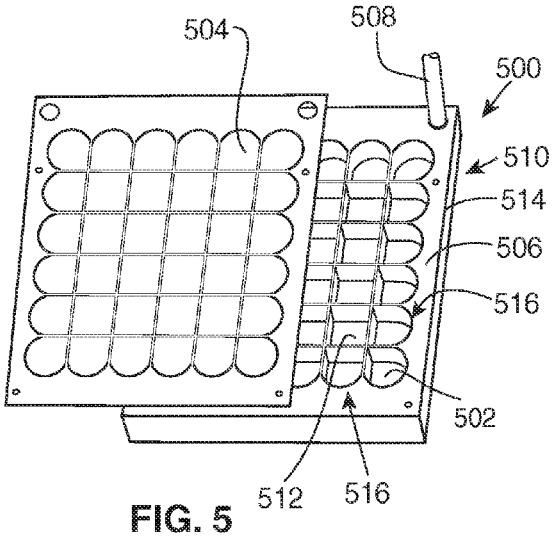
FIG. 5 is a perspective view illustrating another exemplary embodiment of the internal tank structure with an end wall being added to a stack for a small volume, high tank factor, tank, according to an embodiment of the present invention.

Alignment pins 508, such as the one shown in FIG. 5, are inserted into alignment holes 412 and 414 to align the various layers and ensure a good diffusion bond between the layers for structural integrity of the internal chambers 404 and in the final light-weight structure 400.

The creation of such smaller chambers 404 within the pressure vessels 406 and 408 reduces the structural requirements on the outermost metal frame 402, thereby allowing for a light-weight structure 400.

A key element of the present invention is the method used to manufacture the tanks. As discussed in greater detail in regard to FIGS. 20A-20D, the process involves:

1. Slicing a CAD model of the geometry into multiple layers;
2. Generating the necessary "pattern" artwork for each layer;
3. Using the pattern to etch each metal layer and create the pre-formed shapes;
4. Aligning and stacking of each of the layers into a 3D shape, and sandwiching between end wall structures;
5. Diffusion bonding the multiple layers into a single monolithic tank with automatic fluid interconnects between internal chambers; and
6. External machining of the structure to release the final geometry and create access ports.

Figure 6:
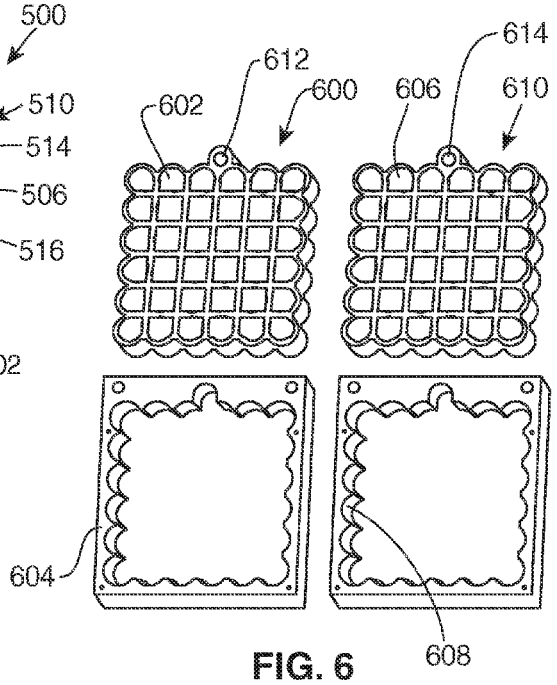
FIG. 6 is a perspective view illustrating two additional embodiments of walled tank structures trimmed via electrical discharge machining (EDM) with respective trimmed external material for a small volume, high tank factor, tank, according to an embodiment of the present invention.

FIG. 5 is a perspective view illustrating another exemplary embodiment of an internal tank structure 506 with an end wall 504 being added to a stack 510 for a small volume, high tank factor, tank 500, according to an embodiment of the present invention. Edge chambers 502 (one of ten labeled) have arcuate internal surfaces 516 and a flat external surface 514, as shown. In a preferred embodiment, the flat external surface 514 will be machined away, as illustrated in FIG. 6. In another embodiment, at least a portion of the flat surface 514 may be retained to assist in fitting tank 500 into another mechanical device or application. Alignment pin 508 is used to align the various layers, similar to layers 1004, 1616, 1510, and 1620 (See FIG. 16), and to ensure a good diffusion bond between the layers for structural integrity of the internal chambers 512 and in the final structure 500. The fingers in the illustration are not part of the invention, but give an approximate size reference. The present invention realizes flat end walls 504 (also 602 and 606 in FIG. 6) in the frame 506 (uncommon in pressure vessels) without sacrificing tank factor and performance.

FIG. 6 is a perspective view illustrating two additional embodiments of walled tanks 600 and 610 with chambers 602 and 606 (one of thirty-six labeled in each), respectively, trimmed via electrical discharge machining (EDM), with respective trimmed external material 604 and 608 for a small volume, high tank factor, tank, according to an embodiment of the present invention. The EDM trimming reduces the weight of the tanks 600 and 610 without sacrifice of required strength. Fluidic couplings 612 and 614 provide both an inlet for charging and discharging the tank 600 and 610, respectively, through a single tube.

Figure 7:
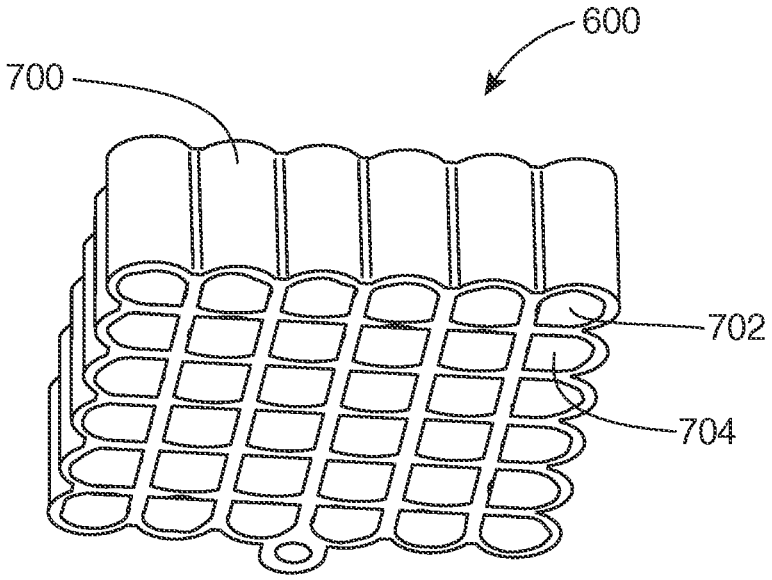
FIG. 7 is a perspective view illustrating another exemplary embodiment of the internal tank structure with end walls for a small volume, high tank factor, tank under hydrostatic testing, according to an embodiment of the present invention.

FIG. 7 is a perspective view illustrating an exemplary embodiment of the internal tank structure 700 with end walls 702 for a small volume, high tank factor, tank 600 under hydrostatic testing, according to an embodiment of the present invention. Hydrostatic testing verifies the ability of the tank 600 to withstand operational pressures. Bulging 704 of the individual chamber 404 end wall 702 portions can be seen.

Figure 8:
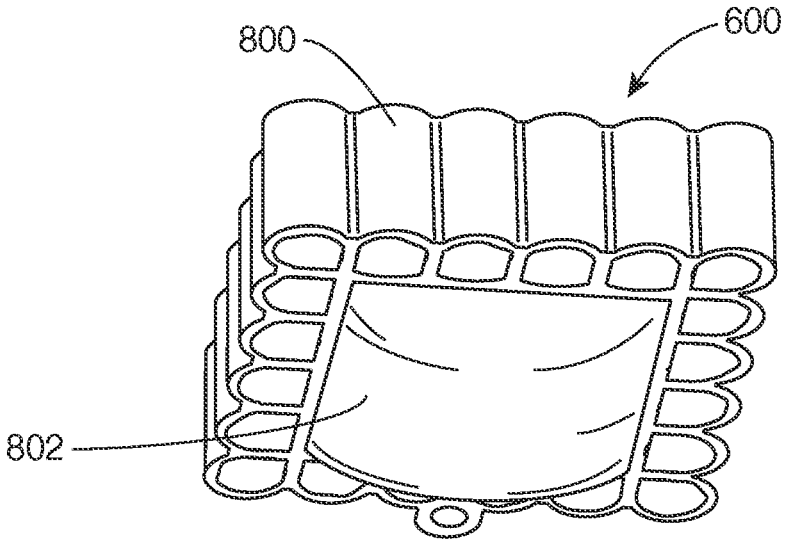
FIG. 8 is a perspective view illustrating another exemplary embodiment of the internal tank structure with end walls for a small volume, high tank factor, tank under hydrostatic testing, according to an embodiment of the present invention.

FIG. 8 is a perspective view illustrating another exemplary embodiment of the internal tank structure 800 with end walls 802 for a small volume, high tank factor, tank 600 under hydrostatic testing, according to an embodiment of the present invention. Testing to failure defines the limits of the tanks' 600 design capability. As shown, the end wall 802 has delaminated between some of the internal chambers 404, but pressure loss has not occurred.

Figure 9:
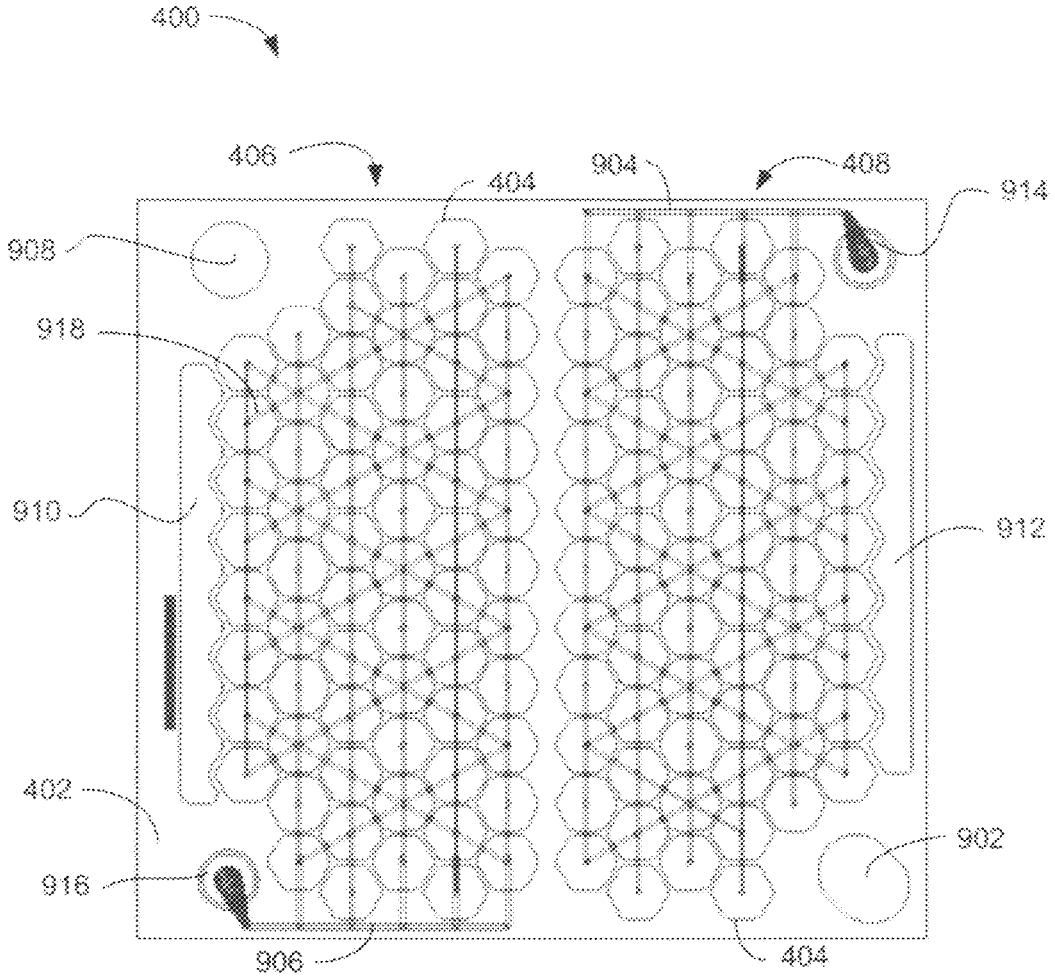
FIG. 9 is a top plan view diagrammatic view illustrating an exemplary arrangement of chambers into two exemplary vessels, according to the exemplary embodiment of FIG. 4.

FIG. 9 is a top plan view diagrammatic view illustrating an exemplary arrangement of chambers 404 into two exemplary first and second vessels 406 and 408, according to the exemplary tank embodiment 400 of FIG. 4. Fluid inlet lines 906 feed fluid to the chambers 404 (one of sixty-four labeled) of first vessel 406 from an inlet conduit 916 that extends outside of the tank 400. Fluid inlet lines 904 feed fluid to the chambers 404 (one of sixty-four labeled) of second vessel 408 from an inlet conduit 914 that extends outside of the tank 400. In a particular preferred embodiment, fluid inlet conduits 914 and 916 may also be used as outlet conduits in an application that first pressurizes the tank 400 with fluid through the inlet conduits 914 and 916 and then releases pressurized fluid out of the tank 400 through conduits 914 and 916. Frame 402 includes alignment pin apertures 902 and 908, as well as first and second mounting apertures 910 and 912. In a preferred embodiment, each vessel 406 and 408 additionally has its own fluid outlet (not shown, but similar to inlets 914 and 916). The design enables realization of a complete tank 400 with automatic interconnects 918 (one of ten diagonals labeled) between internal chambers 404 to allow for fluid connectivity to each of the internal chamber 404 volumes. Interconnects 918 have a lesser depth than the depth of internal chamber 404.

Figure 12:
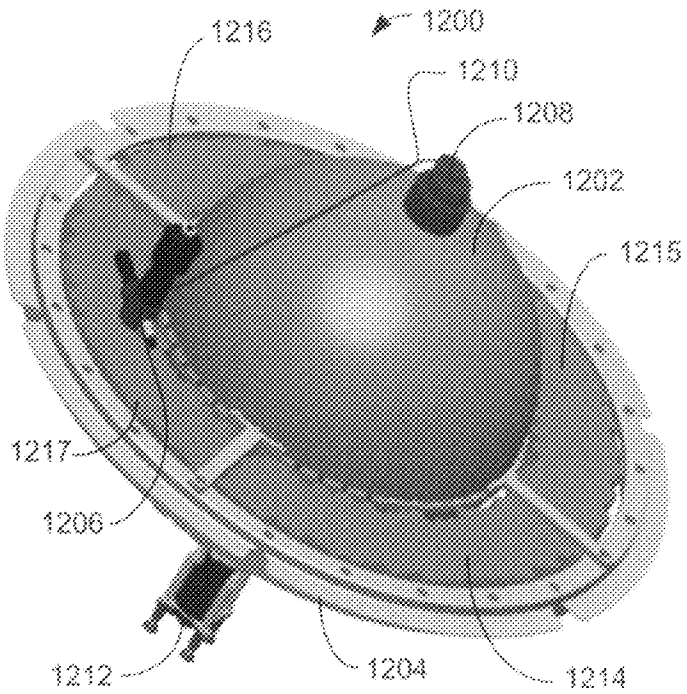
FIG. 12 is a perspective view illustrating a second exemplary rocket propulsion system using exemplary semi-annular tanks, according to an embodiment of the present invention.
Figure 10:
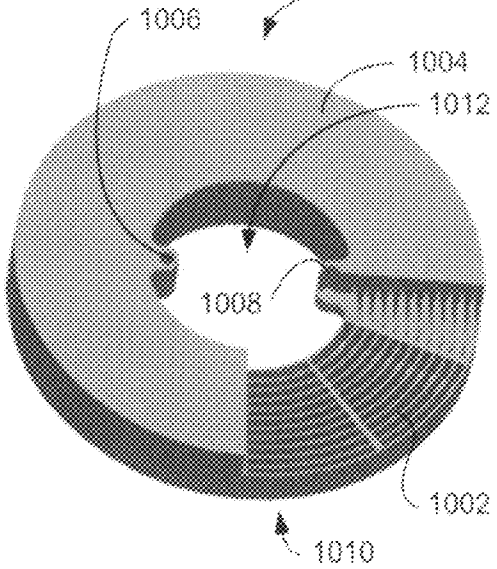
FIG. 10 is a cut-away perspective view illustrating an exemplary annular small volume, high tank factor, tank, according to another embodiment of the present invention.
Figure 11:
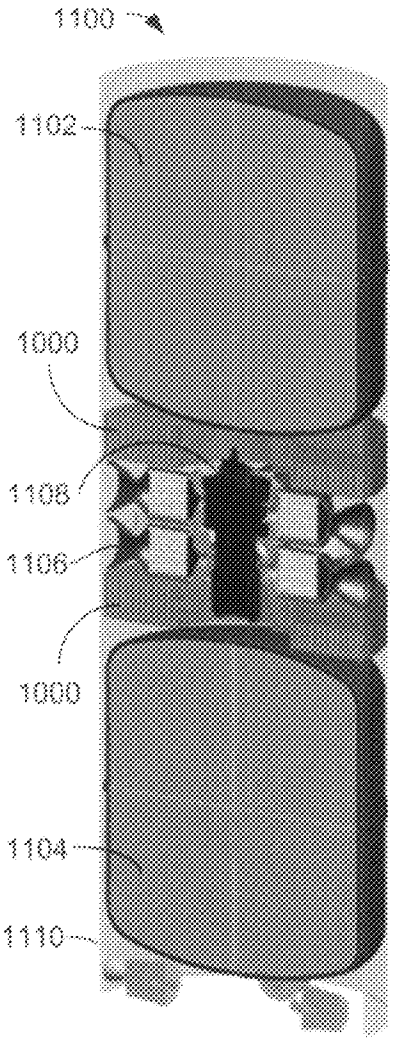
FIG. 11 is a cross-sectional perspective view illustrating a first exemplary application of the exemplary annular tank, according to an embodiment of the present invention.

FIG. 10 is a cut-away perspective view illustrating an exemplary annular small volume, high tank factor, tank 1000, according to another embodiment of the present invention. Each arcuate chamber 1002 (one of many labeled) is fluidically connected to each other arcuate chamber 1002 via fluid conduits (not shown, but see FIG. 9 for example). The outer end wall 1004 seals the top layer of arcuate chambers 1002 in a three-dimensional array 1010 of arcuate chambers 1002. Tank 1000 has first and second vessels (not visible in this view), as with the embodiment 400 of FIG. 4, and has first and second fluid inlets 1006 and 1008 for first and second vessels, respectively. The tank 1000 is formed in a disk-like flat shape that may adaptively and/or conformally shaped to be easily integrated with other devices by attachment or otherwise. FIG. 11 and FIG. 12 show applications in small satellite and rocket propulsion systems, respectively. The opening 1012 is shaped adaptively to a particular application and so may be conformal to a mechanical device to which it will be attached or may provide access for any pipes, regulators, valves, or other structures that may pass through opening 1012 in the particular application.

FIG. 11 is a cross-sectional perspective view illustrating a first exemplary rocket propulsion system 1100 for a small satellite using the exemplary annular tank 1000, according to an embodiment of the present invention. An advantage of the inventive method is the ability to produce an external shape that can be conformal and/or adaptive with an application. The rocket propulsion system 1100 includes first and second fuel tanks 1102 and 1104. In a particular embodiment, first and second fuel tanks 1102 and 1104 may each hold a propellant, such as monopropellant hydrazine. Annular tanks 1000 may hold a pressurant gas, such as nitrogen, to provide pressure to the hydrazine to move the hydrazine through regulator 1108 to one or more thrusters 1106 (one of four labeled). The radially exterior outer wall of tank 1000 is shaped conformally to a housing 1110 for the rocket propulsion system 1100 to make efficient use space and its inner opening 1012 is shaped adaptively to the space requirements of the regulator 1008. In another exemplary embodiment, first fuel tank 1102 may hold a bi-propellant, such as monomethylhydrazine, and second fuel tank 1104 may hold an oxidizer, such as nitrogen tetroxide, each separately pressurized using pressurant gases from annular tanks 1000. Those of skill in the art, enlightened by the present disclosure, will appreciate the many variations of rocket engine systems that may be advantageously created using small tanks 600 and 1000 with high tank factors, including the use of small tanks 1000 to hold propellant, including cold gas propellant.

FIG. 12 is a perspective view illustrating a second exemplary rocket propulsion system 1200 using exemplary semi-annular tanks 1214, 1215, 1216, and 1217, according to an embodiment of the present invention. Four semi-annular tanks 1214, 1215, 1216, and 1217 equatorially surround spherical monopropellant tank 1202 and are supported by frame 1204. Pressurant valve 1206 supplies pressurant gas over line 1210 to pressurant intake valve 1208 of monopropellant tank 1202. The pressurant gas entering monopropellant tank 1202 through pressurant intake valve 1208 forces the monopropellant into thruster and valve assembly 1212 to provide thrust for the rocket propulsion system 1200. In various additional embodiments, the mounting of the semi-annular tanks 1214, 1215, 1216, and 1217 may be non-equatorial. The radially outer wall of tanks 1214, 1215, 1216, and 1217 are shaped adaptively to the frame 1204 and the curvature of the inner walls is shaped conformally to spherical monopropellant tank 1202. Rocket propulsion system 1200 is exemplary of the broad variation in possible shapes for tanks of the present invention.

Figure 13:
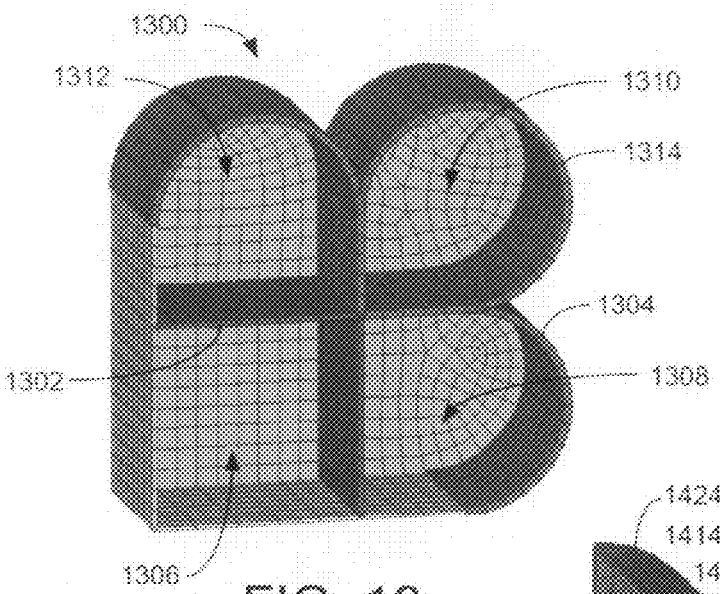
FIG. 13 is a perspective cut-away view of a first alternate exemplary embodiment of arranging chambers into chambers, according to an embodiment of the present invention.

FIG. 13 is a perspective cut-away view of a first additional exemplary embodiment of arranging exemplary tank chambers 1306, 1308, 1310, and 1310 into vessel 1300, according to an embodiment of the present invention. Vessel 1300 is preferably a corner portion of a larger vessel (not shown). Considerable variation in the shapes and wall thicknesses of tank chambers 1306, 1308, 1310, and 1310 is within the scope of the present invention. The minimum wall thickness consistent with required tank strength is preferred and is found using a CAD system or structural analysis. In the illustrated embodiment, only wall 1302 has a thickness of 0.016 inches, while other walls, such as wall 1304, have a thickness of 0.020 inches. Chamber 1306 is a tank interior chamber, chamber 1310 is a tank corner chamber, and chambers 1313 and 1308 are tank edge chambers. Tank corner chamber 1310 has an arcuate substitute 1314 for its two outer walls, having an arcuate surface both internally and externally. Edge chambers 1308 and 1312 each have one arcuate wall. The overall strategy is to provide square interior chambers 1306 and exterior chambers 1308, 1310, and 1312 with arcuate outer walls. The apparatus reflects the method's ability to realize a very wide variety of internal and external shapes and geometrical flexibility in the plane (using CAD to convert the designs into artwork for etching of the metal layers, such as 1004, 1616, 1610, and 1620 shown in FIG. 16).

Figure 14:
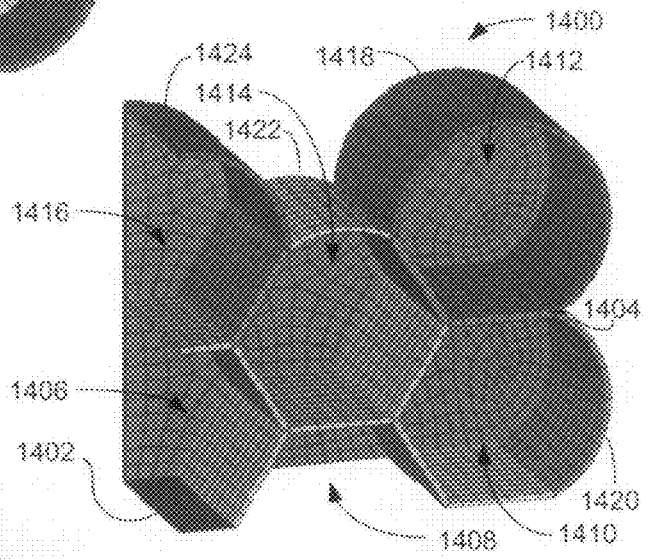
FIG. 14 is a perspective cut-away view of a second alternate exemplary embodiment of arranging chambers into chambers, according to an embodiment of the present invention.

FIG. 14 is a perspective cut-away view of a second alternate exemplary embodiment of arranging exemplary tank chambers 1406, 1408, 1410, 1412, 1414, and 1416 into a vessel 1400, according to an embodiment of the present invention. Vessel 1400 is preferably a corner portion of a larger vessel (not shown). Internal tank chambers 1406 and 1408, illustrated in a cut-away view, are hexagonal in cross section, as shown. Corner tank chamber 1412 has four of its six hexagonal sides merged into an arcuate wall 1418, as shown. A first type of tank edge chamber 1410 and 1416 have two of their outer walls merged into an arcuate outer wall 1420 and 1424, as shown. A second type of edge tank chamber 1414 has one arcuate outer wall 1422, as shown. The minimum wall thickness consistent with required tank strength is preferred and is found using a CAD system. In the illustrated embodiment, only wall 1402 has a thickness of 0.008 inches, while other walls range in thickness up to a thickness of 0.022 inches, such as wall 1404. The overall strategy is to provide hexagonal interior chambers 1406 and 1408 and hexagonal exterior chambers 1410, 1412, 1414, and 1416 with arcuate outer walls 1420, 1418, 1422, and 1424, respectively. An advantage of the inventive method is the ability to produce an external shape that can be conformal with an application. Another advantage of the method used to make vessel 1400 is the ability to make external shapes that are not necessarily spherical or cylindrical, thereby allowing for more efficient usage of available space and the ability to make tanks that are conformal to the devices that use the tanks.

Figure 15:
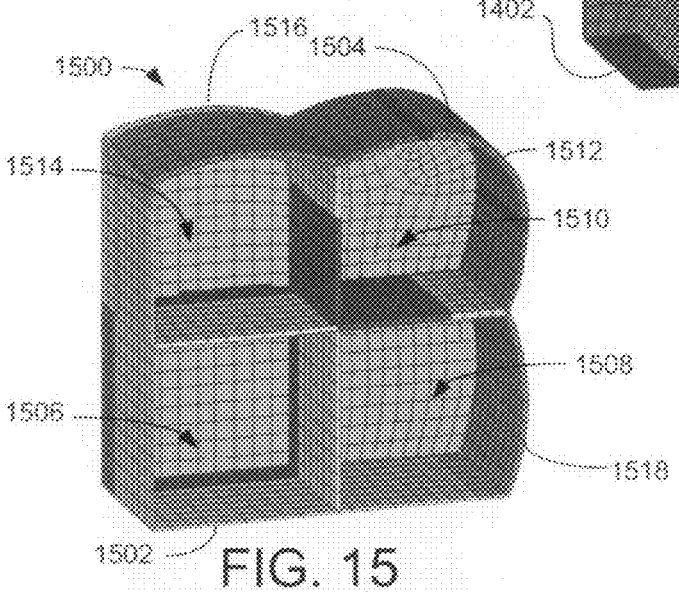
FIG. 15 is a perspective cut-away view of a third alternate exemplary embodiment of arranging chambers into chambers, according to an embodiment of the present invention.

FIG. 15 is a perspective cut-away view of a third alternate exemplary embodiment of arranging square tank chambers 1506, 1508, 1510, and 1512 into a vessel, according to an embodiment of the present invention. Vessel 1500 is preferably a corner portion of a larger vessel (not shown). Internal tank chamber 1506 has a square cross section. Corner chamber 1510 has an arcuate substitute 1512 for two of its walls, providing both an arcuate interior surface and an arcuate exterior surface. Edge chambers 1508 and 1514 each have a an arcuate outer wall 1518 and 1516, respectively, as shown. The minimum wall thickness consistent with required tank strength is preferred and is found using a CAD system. In the illustrated embodiment, only wall 1502 has a thickness of 0.0075 inches, while other walls range in thickness up to a thickness of 0.020 inches, such as wall 1504. The overall strategy is to provide square interior chambers 1506 and also to provide exterior chambers 1508, 1510, and 1514 with arcuate outer walls 1518, 1512 and 1516, as shown.

Figure 16:
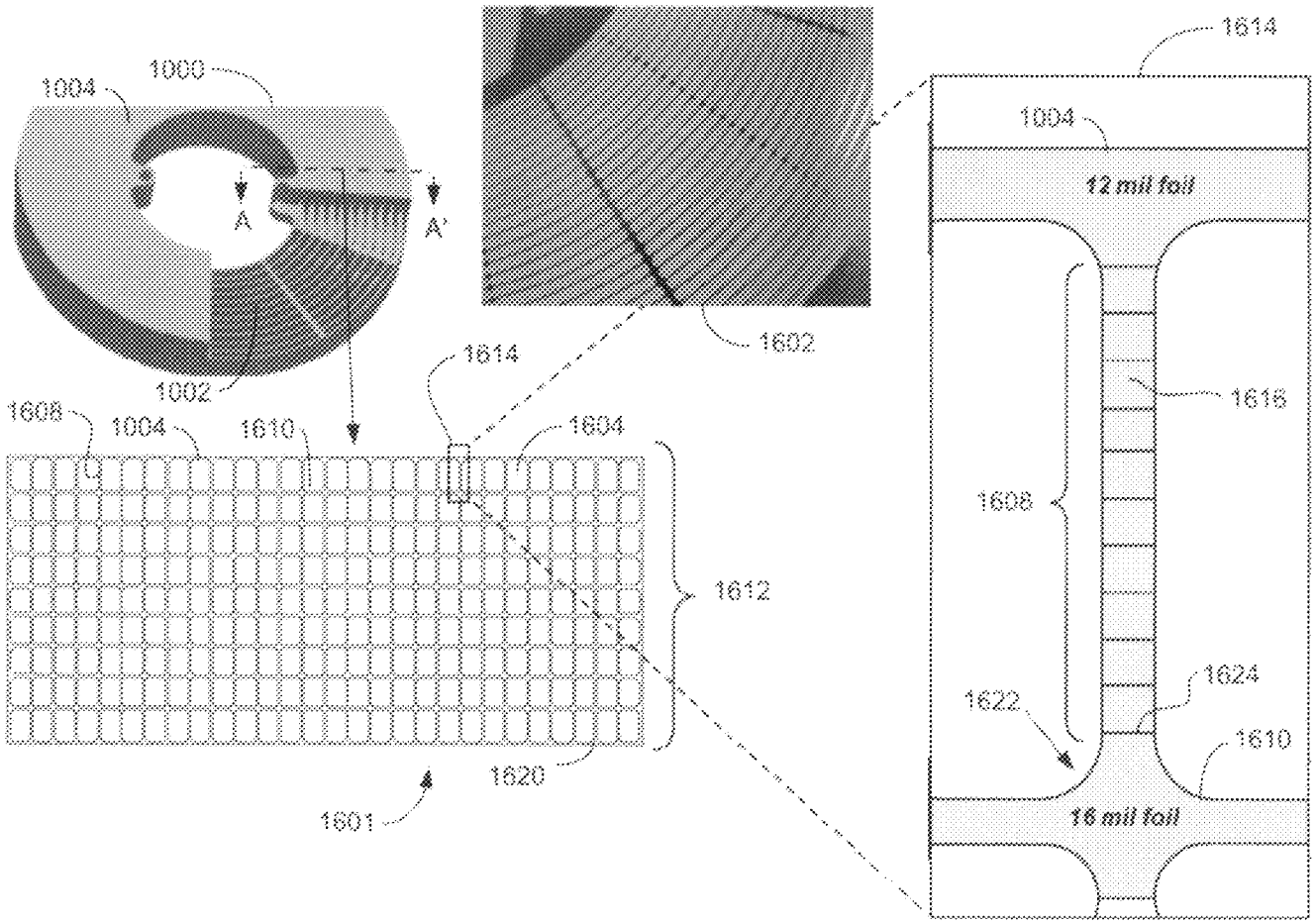
FIG. 16 is a composite of a perspective, cut-away, and diagrammatic views illustrating exemplary inner details of a first annular tank, according to the embodiment of FIG. 10.

FIG. 16 is a composite of perspective, cut-away, and diagrammatic views illustrating exemplary inner details of a first annular tank 1000, according to the embodiment of FIG. 10. Annular tank 1000 is shown in a cut-away perspective view and defines radial section AA'. Arcuate chambers, such as chamber 1002 (one of many labeled), are stacked radially and axially in a two-vessel configuration (not shown). The top foil layer 1004 seals the top layer 1602 of arcuate chambers 1002. The radial cross sectional array 1601 illustrates top edge chamber 1604, with a floor 1610, a side wall 1608 and a top layer 1004. With ten foil layers 1616 (one of ten labeled) per side 1608 of chamber 1604, plus top layer 1004, floor 1610, and bottom 1620 layers, a stack 1612 of one hundred foil layers that are bonded together is shown. The top layer 1004, bottom 1620, and floor 1610 layers have filets 1622 (one of one thousand and eight in cross section 1601 labeled) to avoid a destructive concentration of forces at the corners. Filets 1622 are formed by etching a sixteen mil foil layer down to floor 1610 thickness and a twelve mil layer down to outside wall 1004 thickness, for example. Filets 1622 are used at all corners where chamber walls 1004, 1608, 1610, and back and front chamber walls (not shown, but same as 1608) meet. The seams 1624 (one labeled) between the side 1608 and the floor 1610 or top layer 1004 or bottom 1620 are outside of the filet 1622, so any stress at the chamber corners is engaged by solid material and not by a seam 1624. Side walls 1608 are thinner than can be achieved by other production methods, due to minimum gauge limitations.

Figure 17:
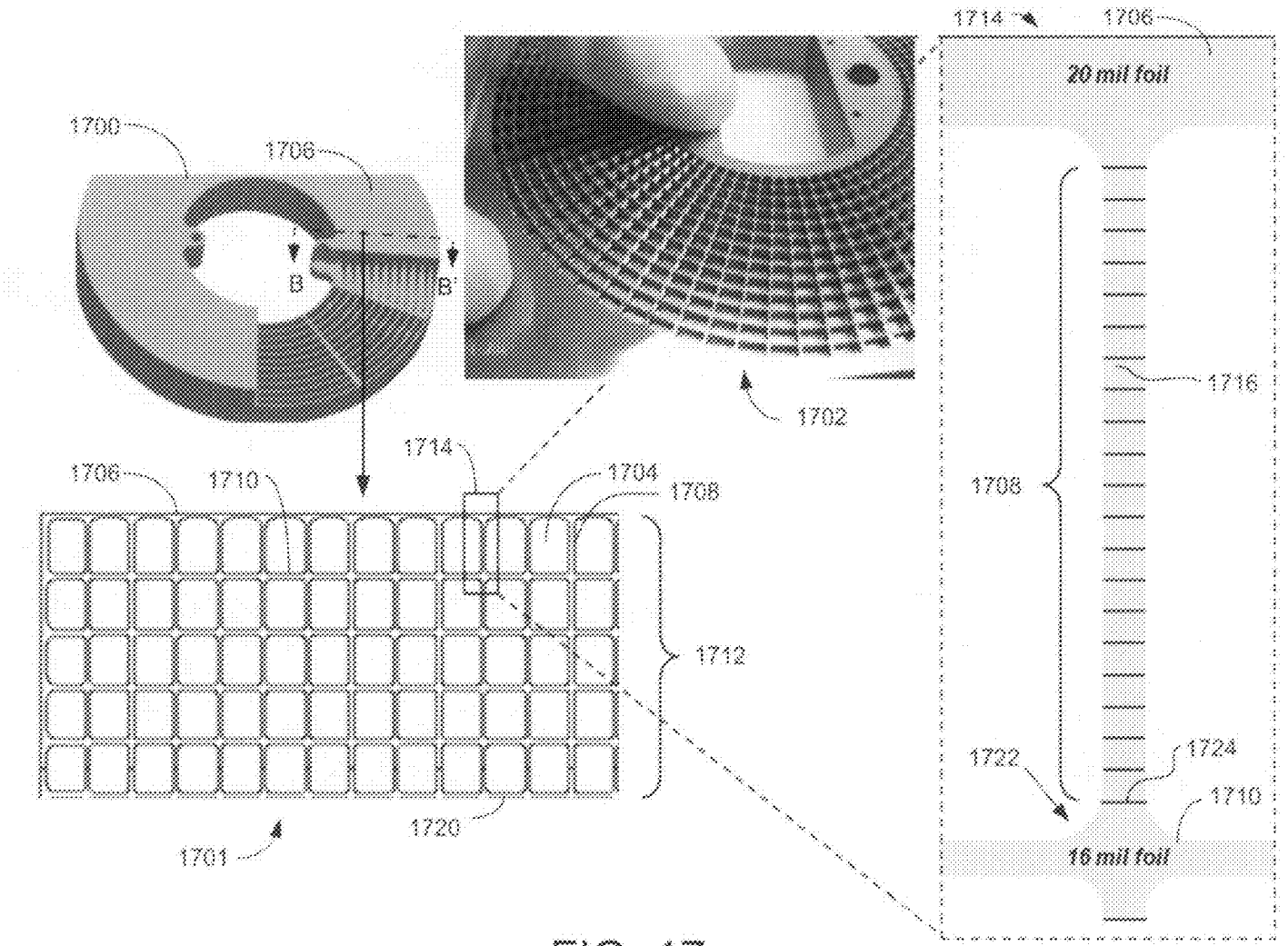
FIG. 17 is a composite of a perspective, cut-away, and diagrammatic views illustrating exemplary inner details of a second annular tank, according to an embodiment of the present invention.

FIG. 17 is a composite of perspective, cut-away, and diagrammatic views illustrating exemplary inner details of a second annular tank 1700, according to an embodiment of the present invention. Chamber walls 1708 of chambers 1704 (one of sixty-five labeled) each have twenty foil layers 1716 (one of twenty labeled). Top layer 1706, floor layers 1710 (one of four labeled) and bottom layer 1720, together with the wall layers 1716 forma stack 1712 of one hundred and six foil layers. Enlarged portion 1714 more clearly illustrates the use of filets 1722 (one of two hundred and sixty in cross section BB' shown as array 1701) to resist stress concentrations at the corners. Seams 1724 are preferably outside the filet 1722. Filets 1722 are formed by etching a sixteen mil foil layer down to floor thickness, for example. Filets 1722 are used at all corners where chamber walls 1706, 1708, 1710, and back and front internal chamber walls (not shown, but same as 1708) meet. Actual chambers 1702 are shorter along their arcuate length than the chambers 1604 of the embodiment of FIG. 16, as shown.

Figure 18:
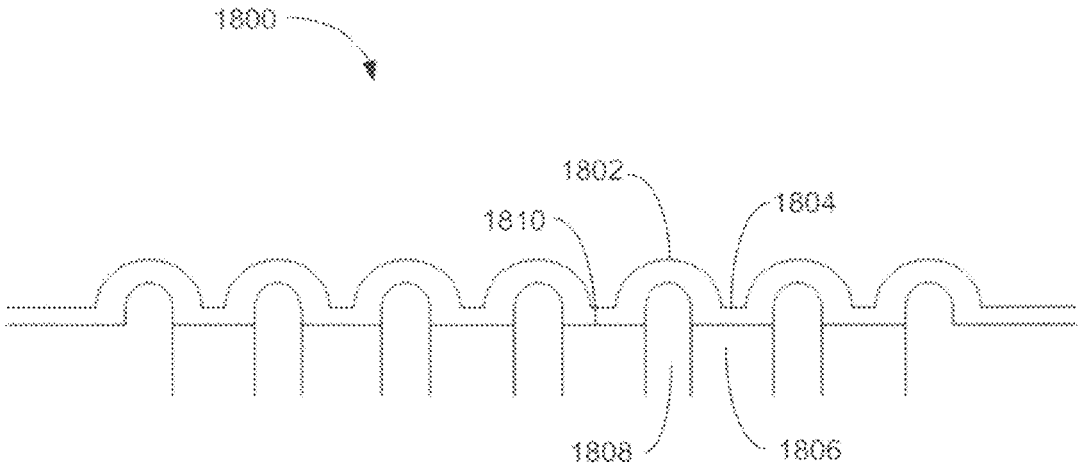
FIG. 18 is a cross-sectional diagrammatic view illustrating exemplary domed end wall portions for the end walls of a tank, according to an embodiment of the present invention.

FIG. 18 is a diagram illustrating exemplary domed end wall portions 1802 for the end wall 1800 of a tank, according to an embodiment of the present invention. Domes 1802 terminate chambers 1808 while flat portions 1804 of the end wall 1800 rest on inner chamber walls 1806. The domed portions 1802, which may be regarded as double filets, avoid stress concentrations at the seam 1810 between the end wall 1800 and the chamber walls 1806.

Figure 19:
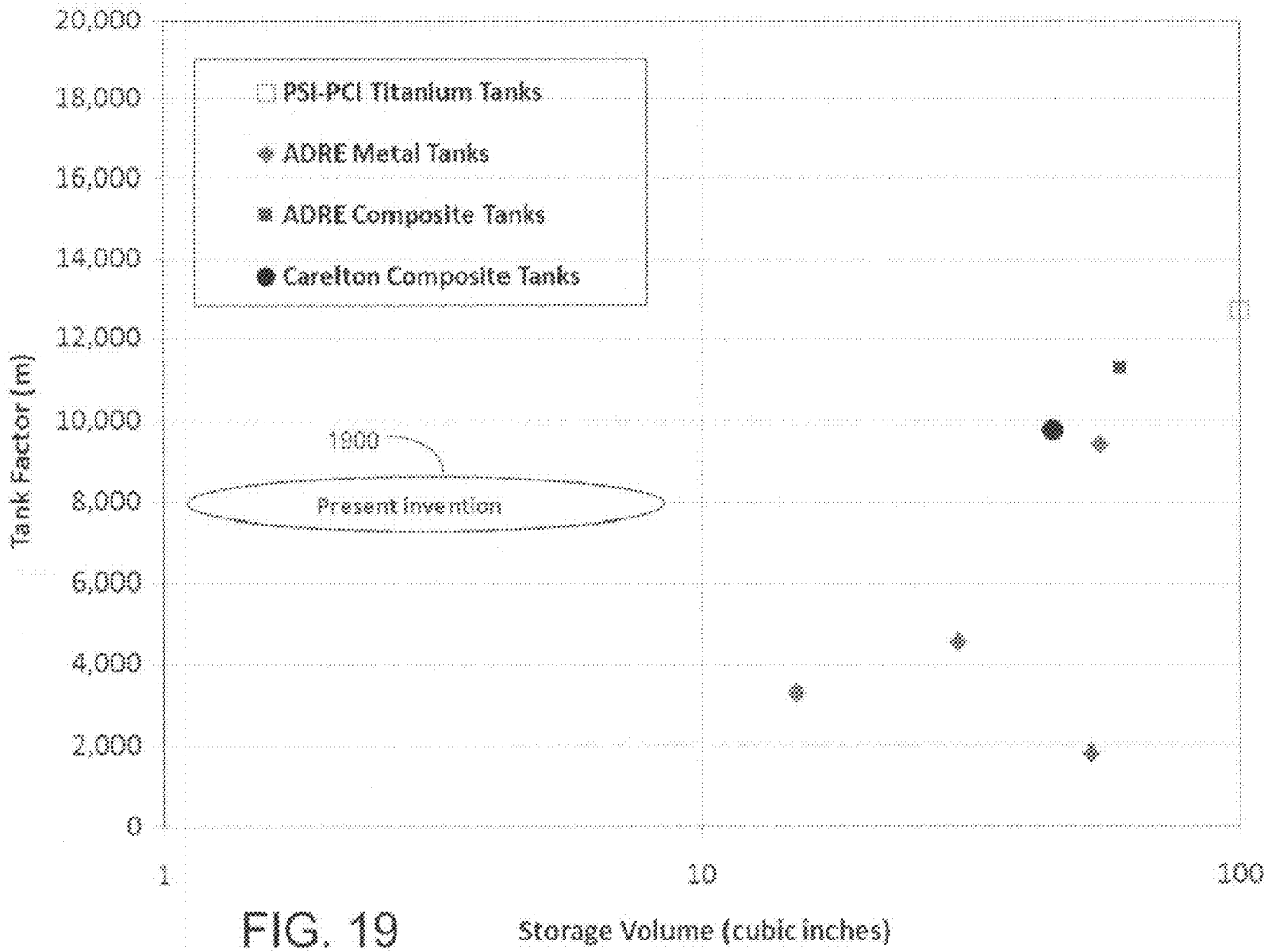
FIG. 19 is a chart illustrating the comparative performance of the present invention and prior art, according to embodiments of the present invention.

FIG. 19 is a chart illustrating the comparative performance of the present invention and prior art, according to all embodiments of the present invention. The present invention creates tanks in a region 1900 bounded by the storage volume range of one-to-ten cubic inches that have tank factors in the neighborhood of eight-thousand meters, depending on the particular embodiment. None of the prior art (see also FIG. 3), can match this performance. Accordingly, the present invention is novel.

Figures 20A, 20B, 20C, 20D:
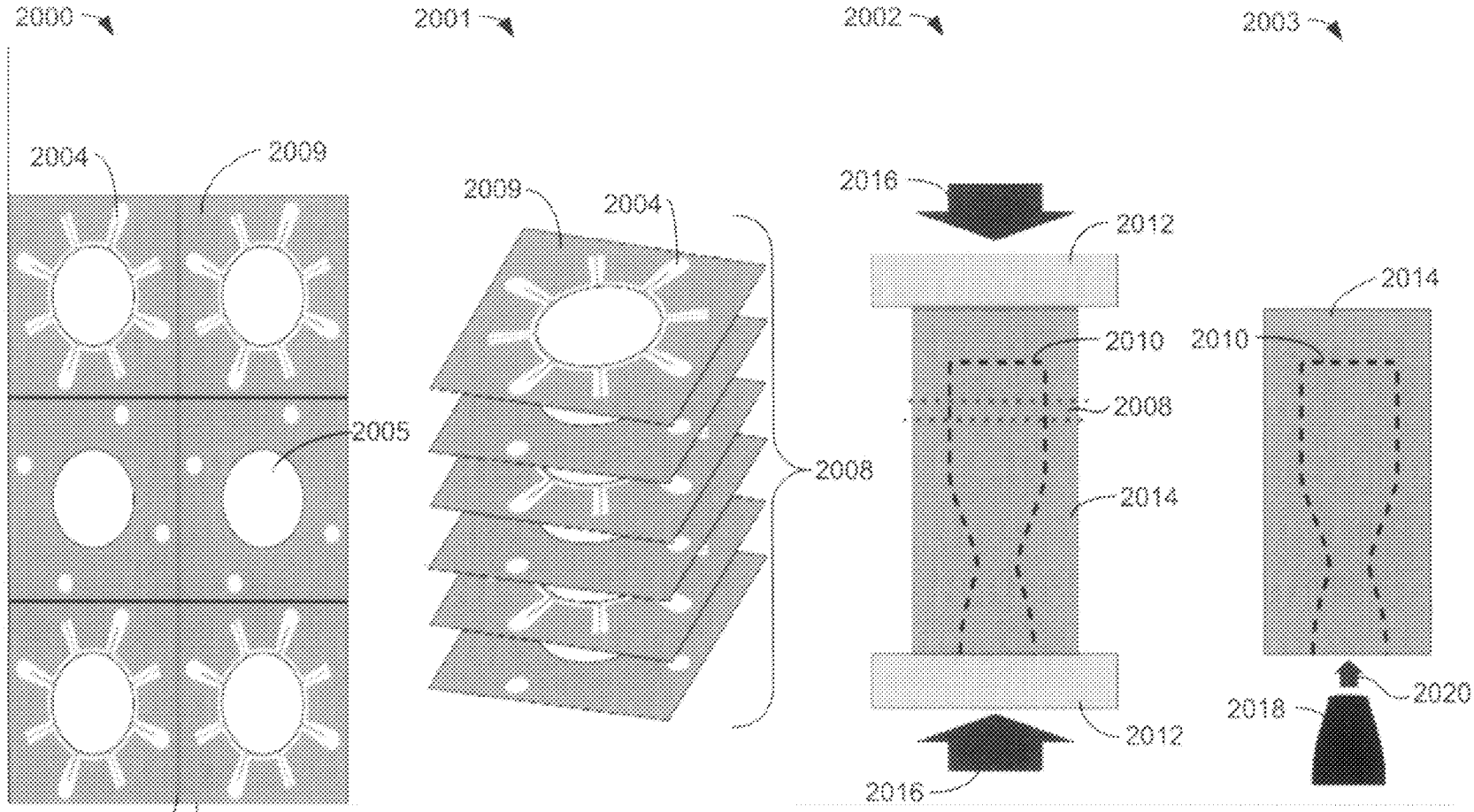
FIG. 20A is a diagrammatic illustration of a first exemplary step in the process of making an exemplary device using stacked etched foil layers, according to an embodiment of the present invention.
FIG. 20B is a diagrammatic illustration of a second exemplary step in the process of making an exemplary device using stacked etched foil layers, according to an embodiment of the present invention.
FIG. 20C is a diagrammatic illustration of a third exemplary step in the process of making an exemplary device using stacked etched foil layers, according to an embodiment of the present invention.
FIG. 20D is a diagrammatic illustration of a fourth exemplary step in the process of making an exemplary device using stacked etched foil layers, according to an embodiment of the present invention.

FIG. 20A is a diagrammatic illustration of a first exemplary step 2000 in the process of making an exemplary device using stacked 2008 (see FIG. 20B) etched foil layers 2009 (one of six labeled), according to an embodiment of the present invention. Each metal foil sheet 2007 is etched with patterns 2004 and 2005, for example, and cut along demarcation lines 2006 into smaller sheets 2009. The exemplary patterns 2004 and 2005 are determined by slicing a 3D CAD model of the device into slices having the same thickness as the metal foil sheet 2007. The device illustrated in FIGS. 20A-20D is a small thruster 2010, but the technique is broadly applicable to the small tank factor tanks of the present invention as well.

FIG. 20B is a diagrammatic illustration of a second exemplary step 2001 in the process of making an exemplary device 2010 using stacked 2008 etched foil layers 2009, according to an embodiment of the present invention. The layers 2009 are stacked 2008 in an aligned configuration, with approximately four hundred layers 2009 per device 2010. Considerable complexity in the patterns, such as patterns 2004 and 2005, is possible with the present method. The illustrated patterns are not intended to be limiting.

FIG. 20C is a diagrammatic illustration of a third exemplary step 2002 in the process of making an exemplary device 2010 using stacked 2008 etched foil layers 2009, according to an embodiment of the present invention. In the third exemplary step 2002, the entire stack 2014, of which stack 2008 is a part is subjected to pressure 2016 in a mechanical press 2012, as well as heat sufficient to bond the metal foil layers 2008 together. The device 2010 has taken form within the entire stack 2014.

FIG. 20D is a diagrammatic illustration of a fourth exemplary step in the process of making an exemplary device using stacked 2008 etched foil layers 2009, according to an embodiment of the present invention. Internal surfaces of the device 2010 may be machined smooth using a finishing tool 2018 intruded 2020 into the entire stack 2014 against the interior surfaces of the device 2010. The exterior of the device 2010 may be trimmed by cutting and finished with grinders and polishers. External flanges, features, and couplings, if desired, may be formed in the trimming and finishing portion of step 2003.

The present invention overcomes the limitation of low tank factors in the small size-class by realizing highly-efficient and light-weight tanks for high-pressure storage of liquids and gases in small storage volumes. As shown in FIG. 19, use of the present invention to realize such small-scale tanks allows for tank factors nearing 8,000 meters in storage volumes as low as 1-10 cubic inches. Other key unique features of the present invention include:

1. Presence of internal walls, exemplified as walls 1608 and 1708, to provide structural integrity and strength while reducing overall weight and external wall thickness;
2. Realization of a complete tank 600, 610, 1000, or 1700 with automatic interconnects 918 between internal chambers 404, 1002, or 1704 to allow for fluid connectivity to each of the internal chamber 404, 1002, or 1704 volumes;
3. Ability to realize wall thicknesses, such as for walls 1304, 1420, 1518, 1614, and 1714, that are much smaller than those allowable by minimum gage limitations;
4. Ability to realize a very wide variety of internal shapes (1300, 1400, and 1500) and geometrical flexibility in the plane (using CAD to convert the designs into artwork for etching of the metal layers 2009);
5. Ability to realize an external shape 600, 610, 1000 that can be conformal with an application;
6. Ability to make external shapes 600, 610, 1000, and 1700 that are not necessarily spherical or cylindrical, thereby allowing for more efficient usage of available space;
7. Ability to realize flat end walls 504, 602, and 606 (uncommon in pressure vessels) without sacrificing tank factor and performance;
8. Placement of end wall fillets 1622 and 1722 in the small-scale tanks 1000 and 1700 to remove stress concentrations and improve performance;
9. Provision for annular 1000 and 1700 and other shapes so as to allow for plumbing channels and other structure 1108 through the tank 1000 (in the middle hole or elsewhere); and
10. Use of scalloped or domed end walls 1802 to further reduce the size and thickness of the external walls for a given level of pressure.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description and following claims will provide those skilled in the art with a convenient road map for implementing the exemplary and additional embodiments. It should be understood that various changes can be made in the function and arrangement of elements without departing from the scope of the invention.

What is claimed is:

1. A small scale metal tank for high pressure storage of fluids comprising:

a. a small scale metal tank comprising:
   i. an enclosure comprising a plurality of outer tank walls;
   ii. at least one array of internal chambers within said enclosure;
   iii. a plurality of fluidic interconnections between each said internal chamber of said array of internal chambers and each internal chamber of said array of internal chambers;
b. a tank volume of at most ten cubic inches
c. a tank factor of at least 3000 meters.

2. The tank of claim 1, comprising:

at least one fluidic conduit between at least one said internal chamber of said at least one array of internal chambers and a point external to said enclosure.

3. The tank of claim 2, wherein at least one said outer tank wall of said plurality of outer tank walls comprises a flat outer tank wall.

4. The tank of claim 2, wherein said enclosure comprises a shape that is at least one of adapted to and conformal to a particular application.

5. The tank of claim 2, wherein said array of internal chambers is formed of diffusion-bonded metal layers having diffusion-bonded seams between adjacent layers.

6. The tank of claim 5, wherein each chamber of said array of internal chambers has:

a. opposed first and second end walls:
b. a plurality of side walls extending between said opposed first and second end walls;
c. an internal junction between a side wall of said plurality of side walls and one of said opposed first and second end walls; and
d. a filet at said internal junction, wherein said filet comprises no said fusion-bonding seams.

7. The tank of claim 6, wherein at least one of said opposed first and second end walls comprises a portion of an outer tank wall of said plurality of outer tank walls and said portion of said outer tank wall comprises an arcuate shape that is at least one of internal and external.

8. The tank of claim 6, wherein at least one side wall of said plurality of side walls comprises a portion of an outer tank wall of said plurality of outer tank walls and said portion of said outer tank wall comprises an arcuate shape that is at least one of internal and external.

9. The tank of claim 2, wherein said at least one array of chambers comprises two or more arrays of chambers, each forming an independent vessel within said enclosure and each having fluidically interconnected chambers within each said two or more arrays of chambers and each vessel having at least one fluidic conduit external to said enclosure.

10. A small scale metal tank for high pressure storage of fluids having:

a. a tank factor of at least three thousand meters; and
b. a tank volume of at most ten cubic inches;
c. wherein said tank comprises:
  i. an enclosure comprising a plurality of outer tank walls;
  ii. at least one array of internal chambers within said enclosure;
  iii. an internal junction between a side wall of said plurality of side walls and one of said opposed first and second end walls; and
  iv. a filet at said internal junction, wherein said filet comprises no said fusion-bonding seams.

11. The tank of claim 10, wherein at least one said outer tank wall of said plurality of outer tank walls comprises a flat outer tank wall.

12. The tank of claim 10, wherein said enclosure comprises:

a. a shape adapted to fit at least one of adaptively and conformally with a particular mechanical device; and
b. a shape that is not spherical.

13. The tank of claim 10, wherein said array of internal chambers is formed of diffusion-bonded metal layers having diffusion-bonded seams between adjacent said diffusion-bonded layers.

14. The tank of claim 13, wherein each chamber of said array of internal chambers has:

a. opposed first and second end walls:
b. a plurality of side walls extending between said first and second end walls;
c. an internal junction between a side wall of said plurality of side walls and one of said first and second end walls; and
d. a filet at said internal junction, wherein said filet comprises no said diffusion-bonding seams.

15. The tank of claim 14, wherein one of said first and second end walls comprises a portion of an outer tank wall of said plurality of outer tank walls and said portion of said outer tank wall comprises an arcuate shape that is at least one of internal and external.

16. The tank of claim 14, wherein one side wall of said plurality of side walls comprises a portion of an outer tank wall of said plurality of outer tank walls and said portion of said outer tank wall comprises an arcuate shape that is at least one of internal and external.

17. The tank of claim 10, wherein said at least one array of chambers comprises two or more arrays of chambers, each forming an independent vessel within said enclosure and each having fluidically interconnected chambers within each said two or more arrays of chambers and each vessel having at least one fluidic conduit terminating external to said enclosure.

18. A small scale metal tank for high pressure storage of fluids having:

a. a tank factor of at least three thousand meters; and
b. a tank volume of at most ten cubic inches;
c. wherein said tank comprises:
  i. an enclosure comprising a plurality of outer tank walls;
  ii. at least one array of internal chambers within said enclosure;
  iii. an internal junction between a side wall of said plurality of side walls and one of said opposed first and second end walls; and
  iv. a filet at said internal junction, wherein said filet comprises no said fusion-bonding seams;
d. wherein said enclosure comprises:
  i. a shape adapted to fit at least one of adaptively and conformally with a particular mechanical device;
  ii. a shape that is not spherical; and
  iii. a shape that does not have a hemispherical tank end;
e. wherein each chamber of said array of internal chambers comprises:
  i. a plurality of diffusion-bonded metal layers having diffusion-bonded seams between adjacent said diffusion-bonded layers;
  ii. opposed first and second end walls each comprising one diffusion-bonded layer of said plurality of said diffusion-bonded layers;
  iii. a plurality of side walls each comprised of a stack of said fusion bonded layers and extending between said opposed first and second end walls;
  iv. an internal junction between a side wall of said plurality of side walls and one of said opposed first and second end walls; and
  v. a filet at each said internal junction, wherein said filet comprises no said diffusion-bonding seams.

19. The tank of claim 18, wherein at least one of said first end wall, said second end wall, and at least one side wall of said plurality of side walls of said chamber comprises a portion of an outer tank wall of said plurality of outer tank walls and said portion of said outer tank wall comprises an arcuate surface that is at least one of internal and external.

20. The tank of claim 18, further comprising said tank attached to said particular mechanical device.

* * * * *